US006148714A

United States Patent [19]

Abe et al.

[11] Patent Number: 6,148,714

[45] Date of Patent: Nov. 21, 2000

[54] RODLESS CYLINDER

[75] Inventors: Takashi Abe; Mitsuhiro Someya, both of Ibaraki-ken, Japan

[73] Assignee: SMC Kabushiki Kaisha, Tokyo, Japan

[21] Appl. No.: 09/233,065

[22] Filed: Jan. 20, 1999

[30] Foreign Application Priority Data

Jan. 20, 1998 [JP] Japan ..... 10-008998

[51] Int. Cl.[7] ..... F01B 29/00

[52] U.S. Cl. ..... 92/88; 92/1

[58] Field of Search ..... 92/1, 88

[56] References Cited

U.S. PATENT DOCUMENTS

| | | | |
|---|---|---|---|
| 4,702,661 | 10/1987 | Bisiach | 92/88 X |
| 4,773,304 | 9/1988 | Granbom | 92/88 X |
| 4,856,415 | 8/1989 | Noda | 92/88 |
| 5,022,499 | 6/1991 | Lundqvist | 92/88 X |
| 5,701,798 | 12/1997 | Noda | 92/88 |
| 5,844,340 | 12/1998 | Noda | 92/88 X |

FOREIGN PATENT DOCUMENTS

| | | |
|---|---|---|
| 8017129 | 9/1981 | Germany . |
| 3240105 | 5/1983 | Germany . |
| 4428648 | 6/1995 | Germany . |
| 296 07 993 U | 9/1996 | Germany . |
| 9-273506 | 10/1997 | Japan . |

*Primary Examiner*—Hoang Nguyen
*Attorney, Agent, or Firm*—Paul A. Guss

[57] ABSTRACT

A cylinder tube is formed in an integrated manner on a base with a support rib intervening therebetween. A slider is displaced in accordance with a displacement action of a piston which is slidable in the cylinder tube. Since the cylinder tube is supported by the support rib, there is no fear of warpage even when the cylinder tube is lengthy. Therefore, the displacement range of the slider is enlarged.

12 Claims, 12 Drawing Sheets

200
348
340
342
342
342
342
346
240
240
X
236b
243
242
328
VIII
332
244b
247b
249b
208
240
336
332
240
216
206
330a
238
249b
VIII
202
X
243
334
245a
222
220
236a
247a
247b
238
249a
244a

RODLESS CYLINDER

BACKGROUND OF THE INVENTION

1. Field of the Invention

The present invention relates to a rodless cylinder for transporting a workpiece or the like by displacing a slider in accordance with reciprocating motion of a piston.

2. Description of the Related Art

A rodless cylinder has been hitherto used, for example, as a means for conveying a workpiece. Such a rodless cylinder is disclosed, for example, in Japanese Laid-Open Patent Publication No. 9-273506 as follows. That is, a piston is inserted into a cylindrical cylinder tube so that the piston is slidable in an axial direction thereof. A plurality of driving magnets, which face the inner wall of the cylinder tube, are disposed on the outer circumference of the piston. On the other hand, a slider, which surrounds the cylinder tube, is provided movably outside the cylinder tube. Driven magnets, which are opposed to the driving magnets and which are slightly separated from the cylinder tube, are disposed on the inner circumference of the slider. A ball bush is provided inside the slider. A columnar guide shaft, which is provided in parallel to the cylinder tube, is inserted through the ball bush. The slider is held in a non-contact state with respect to the cylinder tube by the aid of the guide shaft.

When a pressure fluid such as compressed air is introduced into the cylinder tube, the piston is displaced in the axial direction at the inside of the cylinder tube. During this process, the driven magnets magnetically attract and repel the driving magnets. As a result, the slider is displaced along the outer circumference of the cylinder tube in accordance with the displacement of the piston in a state of being guided by the guide shaft.

The rodless cylinder constructed as described above makes it possible to decrease generation of dust or the like, because the cylinder tube and the slider make no contact with each other. Such a rodless cylinder is appropriately used, for example, for those relating to the medical field and the food as well as for the clean room used in semiconductor production steps.

SUMMARY OF THE INVENTION

A general object of the present invention is to provide a rodless cylinder which makes it possible to hold a cylinder tube and a slider in a non-contact state even when the displacement range of the slider is enlarged, and which makes it possible to reduce generation of dust.

A principal object of the present invention is to provide a rodless cylinder which makes it possible to improve the production accuracy of a cylinder tube and a support rib by forming the support rib integrally with the cylinder tube, and which eliminates any fear of warpage of the cylinder tube that would be otherwise caused by own weight of the cylinder tube, even when the cylinder tube is formed to have a lengthy size.

Another object of the present invention is to provide a rodless cylinder which makes it possible to hold a slider and a cylinder tube in a non-contact state by supporting the slider with a guide element and a guide member.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

The rodless cylinder according to the present invention will be explained in detail below with reference to the accompanying drawings, as exemplified by preferred embodiments.

Figure 1:
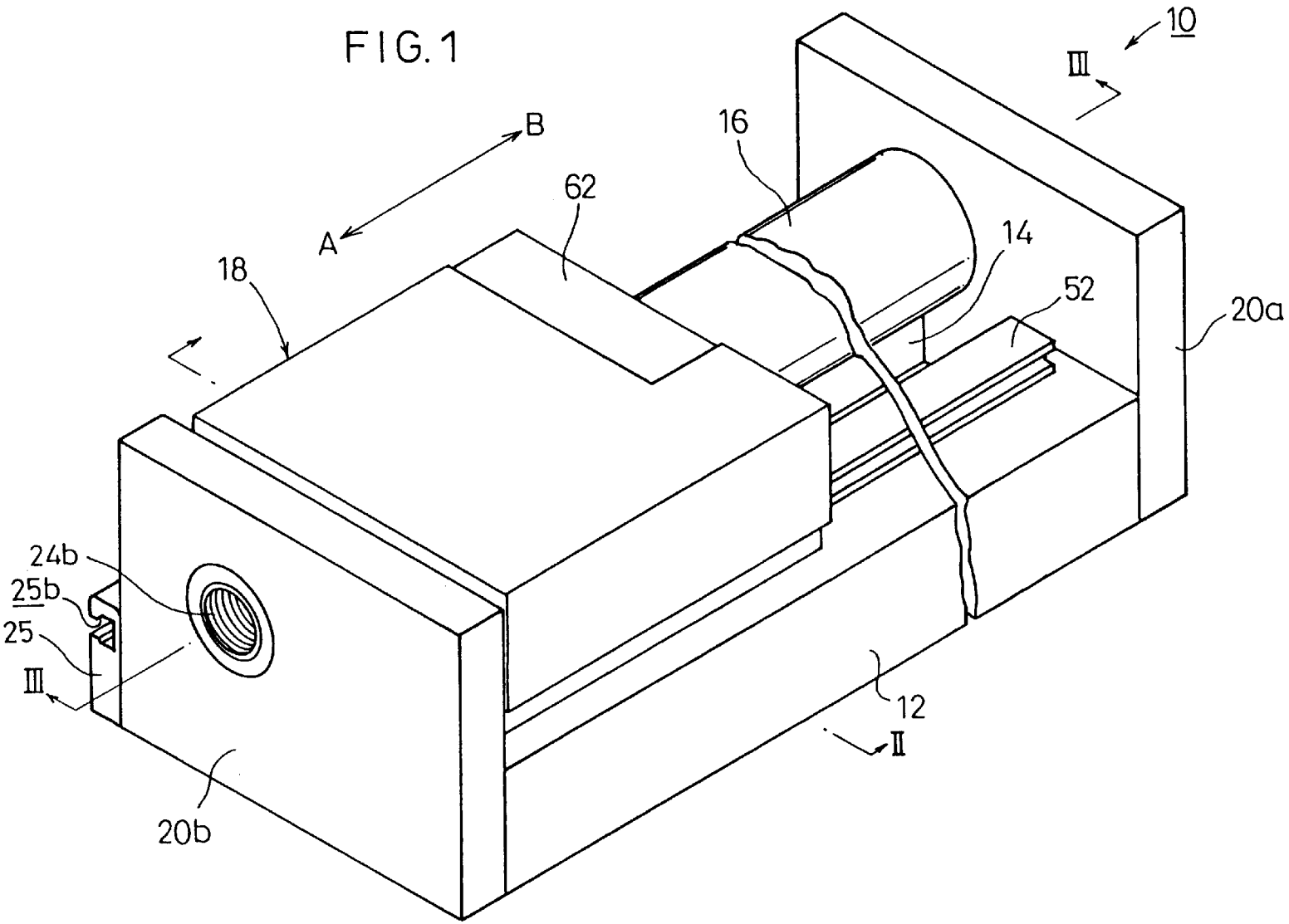
FIG. 1 shows a perspective view illustrating a rodless cylinder according to a first embodiment of the present invention.

With reference to FIG. 1, reference numeral 10 indicates a rodless cylinder according to a first embodiment of the present invention. The rodless cylinder 10 basically comprises a base 12 having a lengthy size, a cylinder tube 16 which is secured along the longitudinal direction of the base 12 and which is supported by a support rib 14, and a slider 18 which is displaceable along the cylinder tube 16.

Figure 2:
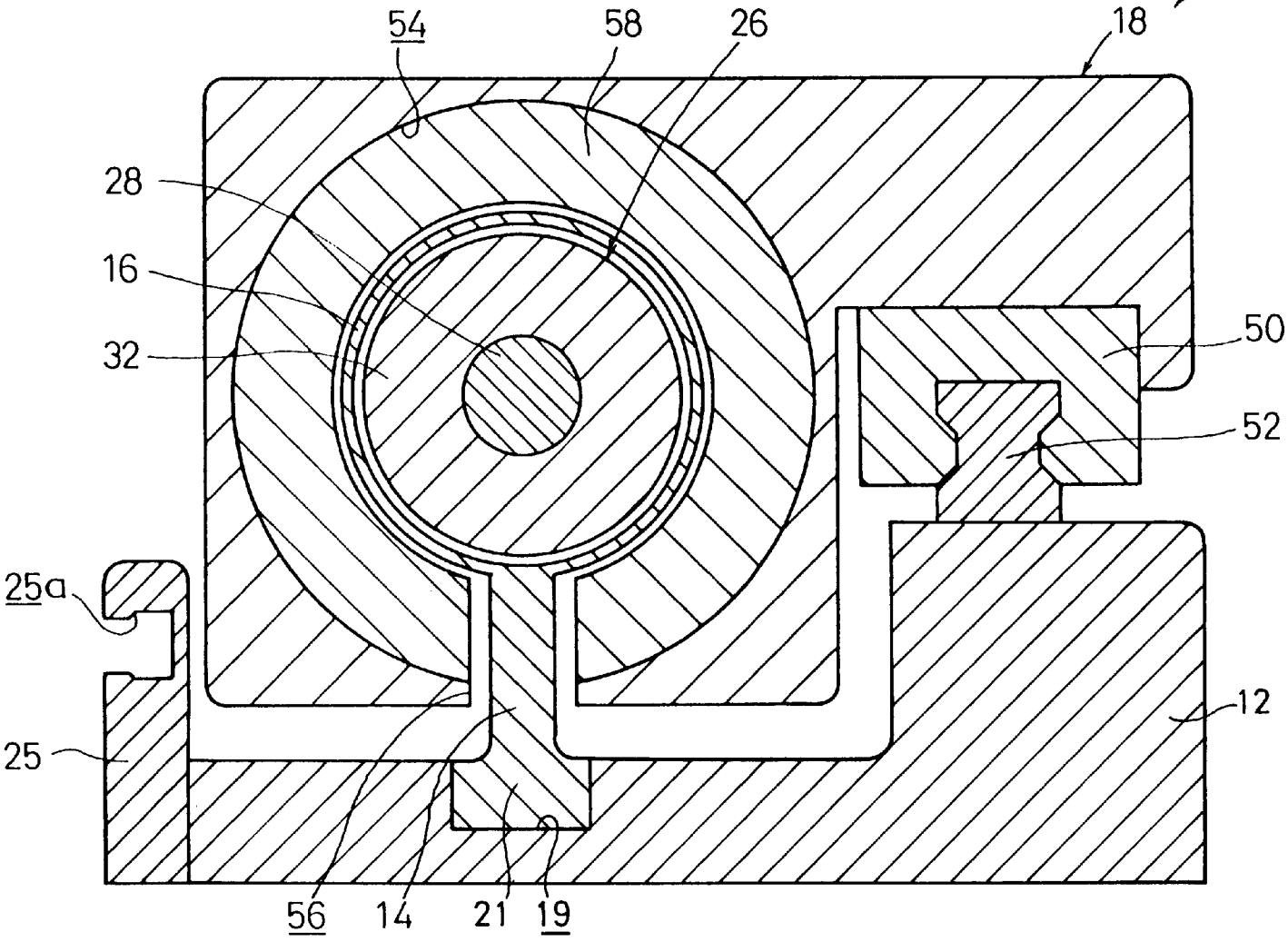
FIG. 2 shows a sectional view taken along a line II—II, illustrating the rodless cylinder shown in FIG. 1.
Figure 3:
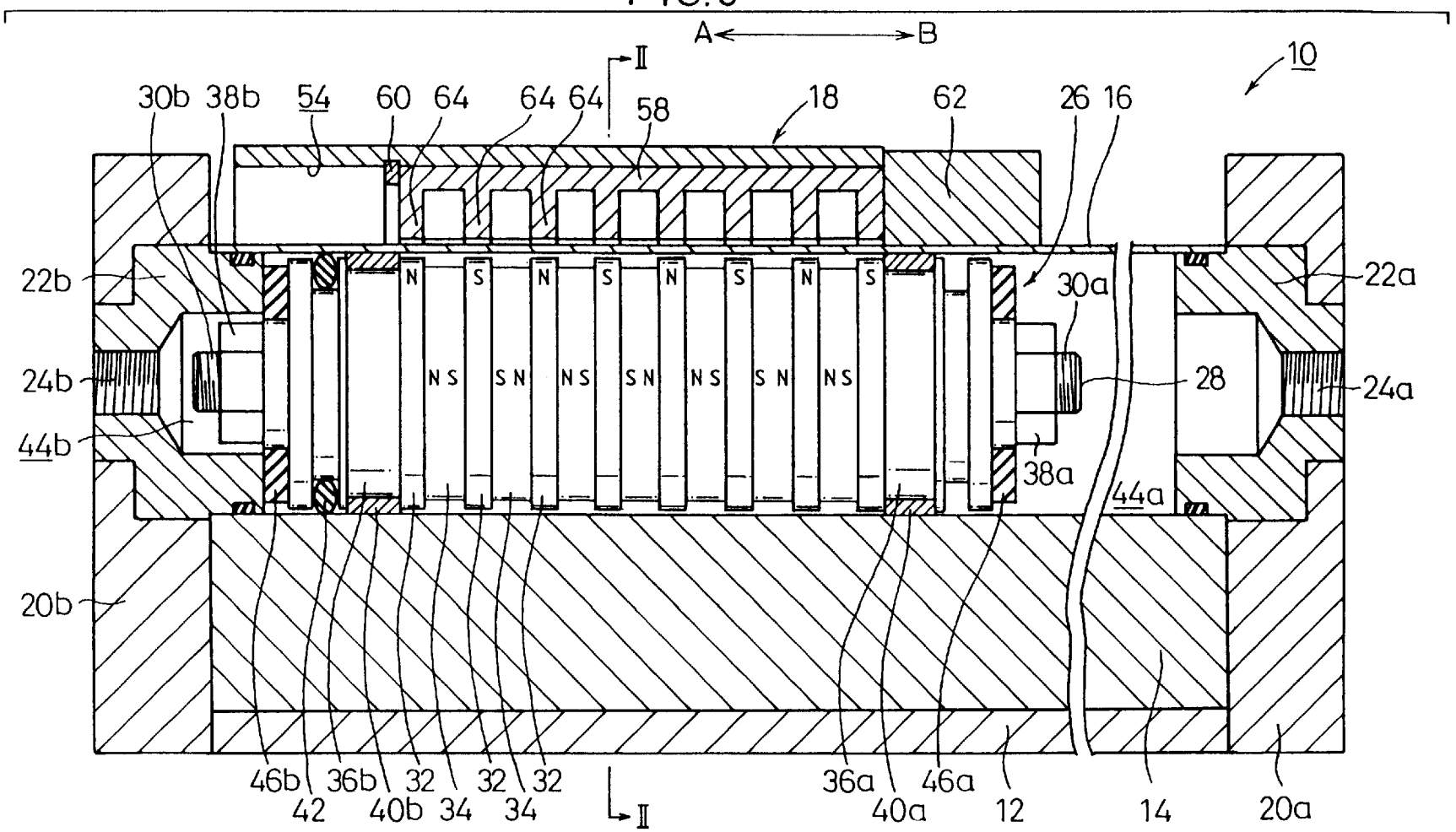
FIG. 3 shows a sectional view taken along a line III—III, illustrating the rodless cylinder shown in FIG. 1.

The base 12 and the cylinder tube 16 are made of a material such as aluminum. As shown in FIG. 2, the base 12 is defined with a groove 19. An engaging section 21, which is formed on the support rib 14 along its longitudinal direction, is engaged with the groove 19. A side plate 25 is secured to one side of the base 12 along its longitudinal direction (see FIG. 2). The side plate 25 is defined with a groove 25*a* for installing an unillustrated magnetic sensor for detecting the position. As shown in FIG. 3, end plates 20*a*, 20*b* are secured to both ends of the base 12. Cap members 22*a*, 22*b* for closing both ends of the cylinder tube 16 are installed to the end plates 20*a*, 20*b* respectively. Ports 24*a*, 24*b* for making communication with the inside of the cylinder tube 16 are formed through the cap members 22*a*, 22*b*. The ports 24*a*, 24*b* are connected to a supply source of a pressure fluid such as compressed air or inert gas, via unillustrated solenoid-operated valves.

A piston 26 is disposed slidably at the inside of the cylinder tube 16. The piston 26 comprises, at its central portion, a rod-shaped core member 28 which is lengthy in the axial direction. Male threads 30*a,* 30*b* are formed on both ends of the core member 28. A plurality of ring members 32, which are made of a material such as iron as a magnetic member, are provided on the outer circumference of the core member 28. Driving magnets 34, each of which has a diameter slightly smaller than that of the ring member 32, are interposed between the respective ring members 32. The respective driving magnets 34 are isolated from each other by the ring members 32. Each of the driving magnets 34 is formed to have the north pole on one surface and the south pole on the other surface. The adjoining driving magnets 34 are arranged so that their polarities are in mutually opposite directions. Therefore, the magnetic fields of the north pole and the south pole are alternately generated on the outer circumferences of the adjoining ring members 32.

Cylindrical members 36*a,* 36*b* are fitted to the outer circumference of the core member 28 while the ring members 32 and the driving magnets 34 are interposed therebetween. The cylindrical members 36*a,* 36*b,* the ring members 32, and the driving magnets 34 are assembled in an integrated manner by screwing nuts 38*a,* 38*b* into the male threads 30*a,* 30*b.* Bushes 40*a,* 40*b,* which are slidable on the inner circumference of the cylinder tube 16, are provided on the outer circumferences of the cylindrical members 36*a,* 36*b.* A packing 42 is provided on the outer circumference of one of the cylindrical members 36*b.* The packing 42 shuts out leakage of the pressure fluid introduced into the cylinder tube 16. Therefore, the interior of the cylinder tube 16 is separated by the piston 26 into a chamber 44*a* disposed on a first end side and a chamber 44*b* disposed on a second end side. Dampers 46*a,* 46*b* are provided at ends of the piston 26. The dampers 46*a,* 46*b* absorb the shock which would be otherwise caused when the piston 26 is displaced to collide with the cap members 22*a,* 22*b.* When the piston 26 is provided with air dampers (not shown) in place of the dampers 46*a,* 46*b,* it is possible to more effectively absorb the shock and avoid the dust generation which would be otherwise caused when the piston 26 collides with the cap members 22*a,* 22*b.*

As shown in FIG. 2, a guide block (guide element) 50, which is opposed to the base 12, is secured to the slider 18. The guide block 50 is slidably engaged with a guide rail (guide member) 52 which is secured to the base 12. The slider 18 is defined with a hole 54 into which the cylinder tube 16 is inserted along the longitudinal direction, and a slit 56 which communicates with the hole 54 and into which the support rib 14 is inserted. A yoke 58, which is made of a magnetic member, is inserted into the hole 54. The yoke 58 is formed to have a substantially C-shaped cross section. The slider 18 is supported by the guide block 50 and the guide rail 52, and thus the yoke 58 is held while being slightly separated from the cylinder tube 16 and the support rib 14. As shown in FIG. 3, a first end of the yoke 58 is positioned by a C-ring 60. A second end of the yoke 58 is prevented from disengagement by the aid of an end member 62 which is secured to the slider 18. The inner circumference of the end member 62 is slightly separated from the outer circumference of the cylinder tube 16. A plurality of projections 64 are formed on the inner circumference of the yoke 58. The projections 64 are attracted by the magnetic force of the driving magnets 34 generated over the outer circumferences of the ring members 32.

The rodless cylinder 10 according to the first embodiment is basically constructed as described above. Next, its operation, function, and effect will be explained.

When the unillustrated solenoid-operated valves are operated to introduce the pressure fluid into the first port 24*a* and allow the second port 24*b* to be in the state open to the atmospheric air, the pressure fluid is introduced from the port 24*a* into the chamber 44*a* of the cylinder tube 16. The pressure of the pressure fluid causes the piston 26 to slide in the direction indicated by the arrow A. Accordingly, the driving magnets 34 are displaced, and the projections 64 of the yoke 58 are attracted by the magnetic force generated over the outer circumferences of the ring members 32. Thus, the slider 18 is displaced in the direction of the arrow A along the cylinder tube 16. On the other hand, when the unillustrated solenoid-operated valves are operated to allow the first port 24*a* to be in the state open to the atmospheric air and introduce the pressure fluid into the second port 24*b,* then the pressure fluid is introduced into the chamber 44*b,* and the piston 26 slides in the direction indicated by the arrow B. Accordingly, the yoke 58 is attracted by the magnetic force of the ring members 32, and the slider 18 is displaced in the direction of the arrow B in the same manner as described above.

The rodless cylinder 10 according to the first embodiment is advantageous as follows. When the cylinder tube 16 is formed to be long in order to increase the displacement range of the slider 18, the force to cause warpage is applied to the cylinder tube 16 due to its own weight. However, since the cylinder tube 16 is supported by the support rib 14, the cylinder tube 16 is prevented from warpage. Therefore, the yoke 58 does not make contact with the cylinder tube 16, and it is possible to form the cylinder tube 16 to have a lengthy size. Thus, it is easy to enlarge the displacement range of the slider 18.

Further, when the rodless cylinder 10 is used in an environment such as under vacuum, it is not feared that a minute amount of gas generated from a magnet would be scattered to the outside of the rodless cylinder 10. Therefore, the rodless cylinder 10 can be used to transport a workpiece or the like in the vacuum environment without the pollution of the vacuum environment. Further, for example, in the case of an environment in which the performance of the magnet is lowered as in a high temperature environment used for the baking step or the like, the rodless cylinder 10 can be used even in such an environment, because the driving magnets 34 of the piston are not heated to an excessively high temperature owing to the fact that they are isolated from the high temperature environment by the aid of the cylinder tube 16, while the slider 18 includes no magnet.

In such a case, it is preferable for the sliding sections of the guide rail 52 and the guide block 50 to use a lubricating method (for example, grease or solid lubrication) corresponding to the degree of vacuum of the environment in which the rodless cylinder 10 is used. By doing so, it is possible to avoid the dust generation which would be otherwise caused by the sliding movement effected by the guide rail 52 and the guide block 50. When the guide rail 52 and the guide block 50 are made of a corrosion-preventive material corresponding to the environment in which the rodless cylinder 10 is used, it is possible to further decrease the dust generation, which is preferred.

Figure 4:
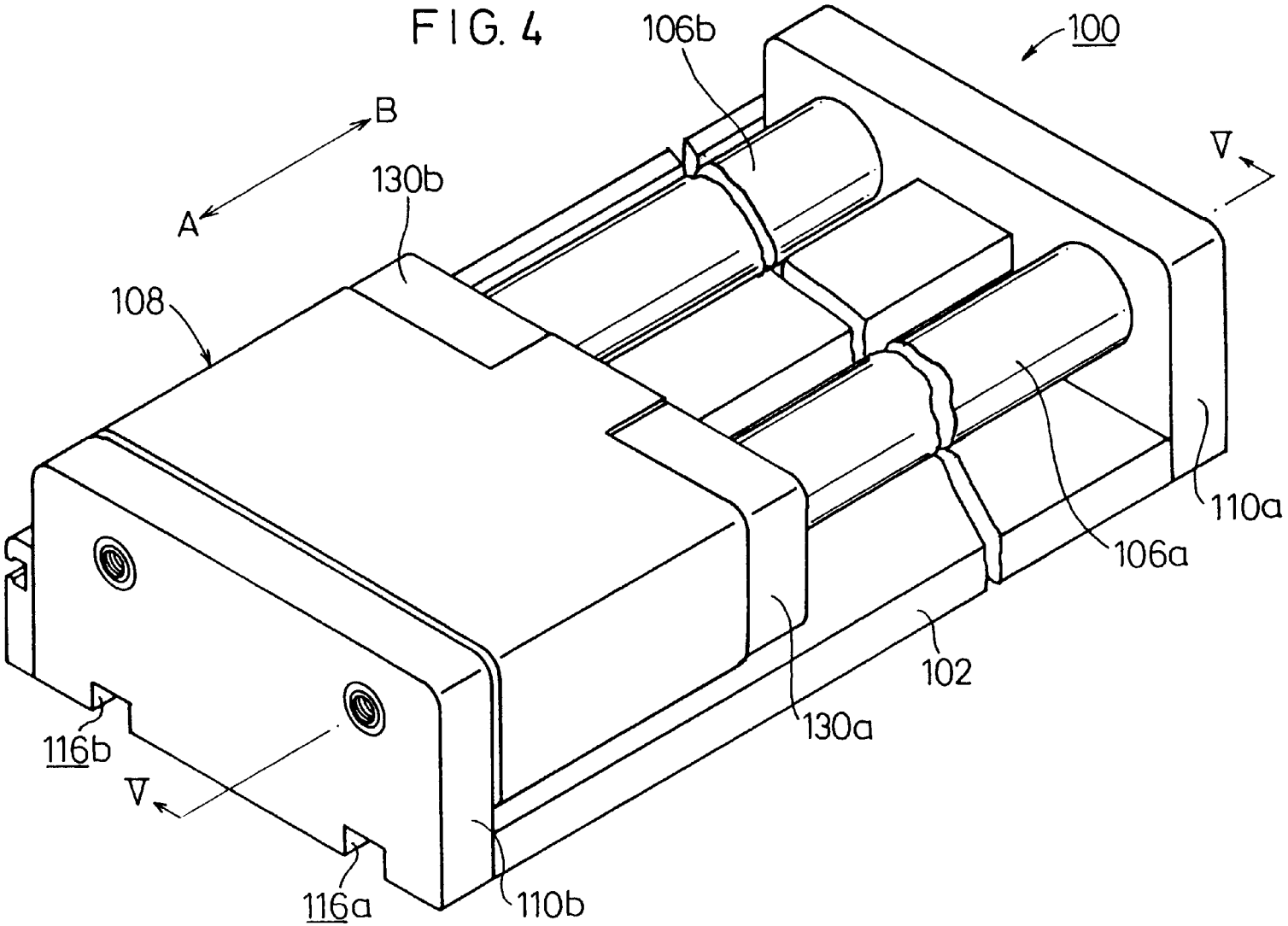
FIG. 4 shows a perspective view illustrating a rodless cylinder according to a second embodiment of the present invention.

Next, a rodless cylinder 100 according to a second embodiment will be explained with reference to FIG. 4. Components or parts, which are equivalent to those described in the first end, are designated by the same reference numerals, detailed explanation of which will be omitted.

The rodless cylinder 100 basically comprises a lengthy base 102, two cylinder tubes 106*a,* 106*b* which are provided along the longitudinal direction of the base 102, and a slider 108 which is displaceable along the cylinder tubes 106*a,* 106*b.*

Figure 5:
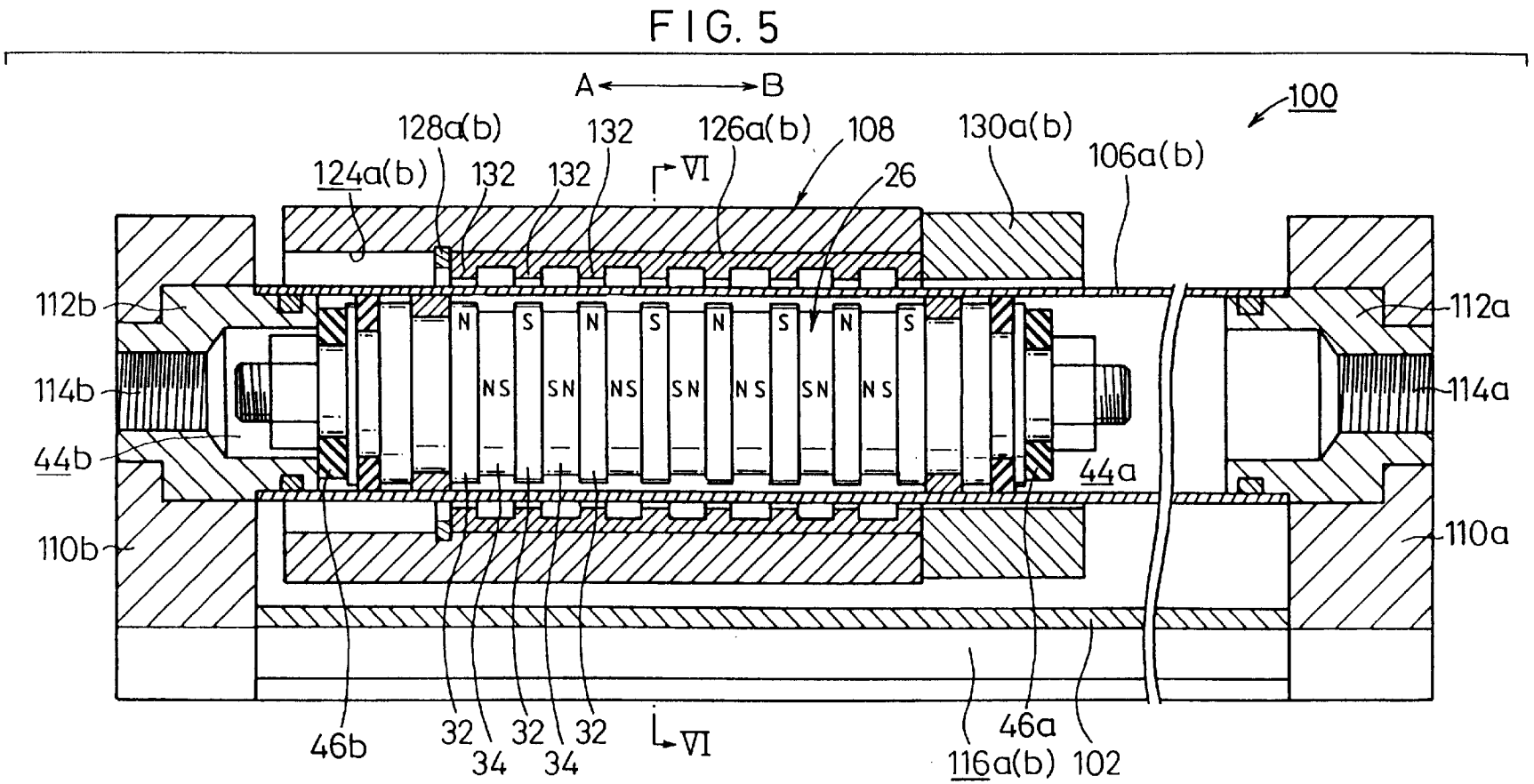
FIG. 5 shows a sectional view taken along a line V—V, illustrating the rodless cylinder shown in FIG. 4.

End plates 110*a,* 110*b* are secured to both ends of the base 102. As shown in FIG. 5, cap members 112*a,* 112*b* for closing both ends of the cylinder tubes 106*a,* 106*b* are secured to the end plates 110*a,* 110*b*. Ports 114*a,* 114*b,* which communicate with the inside of the cylinder tubes 106*a,* 106*b,* are formed through the cap members 112*a,* 112*b*. The ports 114*a,* 114*b* are connected to a pressure fluid supply source via unillustrated solenoid-operated valves.

Figure 6:
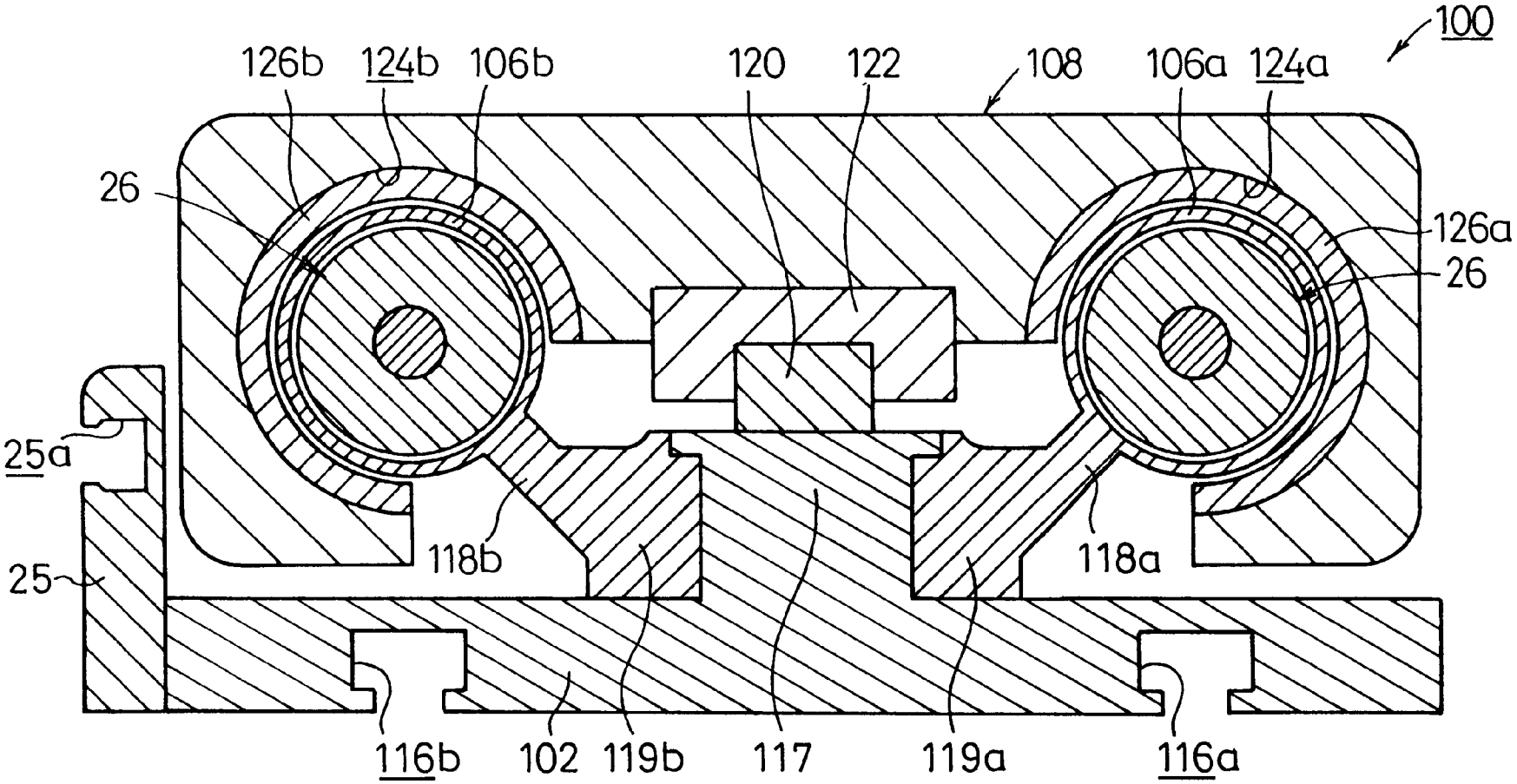
FIG. 6 shows a sectional view taken along a line VI—VI, illustrating the rodless cylinder shown in FIG. 5.

As shown in FIG. 6, grooves 116*a,* 116*b,* which are used to attach the rodless cylinder 100 to another equipment or the like, are defined at lower portions of the base 102 along its longitudinal direction. A protrusion 117 is formed at an upper portion of the base 102. Engaging sections 119*a,* 119*b* of support ribs 118*a,* 118*b,* which are formed integrally with the cylinder tubes 106*a,* 106*b,* are secured to both sides of the protrusion 117. The support ribs 118*a,* 118*b* are arranged to be inclined with respect to the base 102. A guide rail (guide member) 120 is secured to an upper portion of the protrusion 117. A guide block (guide element) 122, which is secured to the slider 108, is slidably engaged with the guide rail 120. The slider 108 is defined with recesses 124*a,* 124*b* for inserting the cylinder tubes 106*a,* 106*b* and the support ribs 118*a,* 118*b* therethrough. Yokes 126*a,* 126*b,* each of which are formed of a magnetic member, are inserted into the recesses 124*a,* 124*b*. As shown in FIG. 5, first ends of the yokes 126*a,* 126*b* are positioned by C-rings 128*a,* 128*b*. Second ends of the yokes 126*a,* 126*b* are prevented from disengagement by the aid of end members 130*a,* 130*b*. A plurality of projections 132 are formed on the inner circumference of each of the yokes 126*a,* 126*b*. The projections 132 are attracted by the magnetic force of the driving magnets 34 generated over the outer circumferences of the ring members 32.

The rodless cylinder 100 according to the second embodiment is used as follows.

When the unillustrated solenoid-operated valves are operated to introduce the pressure fluid into the first ports 114*a* and allow the second ports 114*b* to be in the state open to the atmospheric air, the pressure fluid is introduced from the ports 114*a* into the chambers 44*a* of the cylinder tubes 106*a,* 106*b*. The pressure of the pressure fluid causes the pistons 26 to slide in the direction indicated by the arrow A. Accordingly, the driving magnets 34 are displaced, and the projections 132 of the yokes 126*a,* 126*b* are attracted by the magnetic force generated over the outer circumferences of the ring members 32. Thus, the slider 108 is displaced in the direction of the arrow A along the cylinder tubes 106*a,* 106*b*. On the other hand, when the unillustrated solenoid-operated valves are operated to allow the first ports 114*a* to be in the state open to the atmospheric air and introduce the pressure fluid into the second ports 114*b,* then the pressure fluid is introduced into the chambers 44*b,* and the pistons 26 slide in the direction indicated by the arrow B. Accordingly, the yokes 126*a,* 126*b* are attracted by the magnetic force of the ring members 32, and the slider 108 is displaced in the direction of the arrow B in the same manner as described above.

The cylinder tubes 106*a,* 106*b* of the rodless cylinder 100 are supported by the support ribs 118*a,* 118*b*. Accordingly, even when the cylinder tubes 106*a,* 106*b* are formed to be long in order to increase the displacement range of the slider 108, there is no fear of warpage of the cylinder tubes 106*a,* 106*b*. Therefore, even when the cylinder tubes 106*a,* 106*b* are formed to have a lengthy size, it is not feared that the projections 132 formed on the yokes 126*a,* 126 make contact with the cylinder tubes 106*a,* 106*b*. It is easy to enlarge the displacement range of the slider 108. There is no fear of dust generation which would be otherwise caused by the contact between the cylinder tubes 106*a,* 106*b* and the projections 132 formed on the yokes 126*a,* 126*b*.

When the workpiece has a light weight, the slider 108 can be displaced by using only one of the cylinder tubes 106*a* (or 106*b*). Accordingly, it is possible to save the amount of consumption of the pressure fluid, and it is possible to reduce the operation cost of the rodless cylinder 100. Therefore, it is possible to select whether the workpiece is transported by using only one of the cylinder tubes 106*a* (or 106*b*) or the workpiece is transported by using both of the cylinder tubes 106*a,* 106*b*. It is possible to set the rodless cylinder 100 to use an appropriate holding force and an appropriate amount of consumption of the pressure fluid corresponding to the weight of the workpiece. When the workpiece is transported by using only one of the cylinder tubes 106*a* (or 106*b*), it is sufficient that the piston 26 is provided only for one of the cylinder tubes 106*a* (or 106*b*). Thus, it is possible to reduce the production cost of the rodless cylinder 100.

Figure 7:
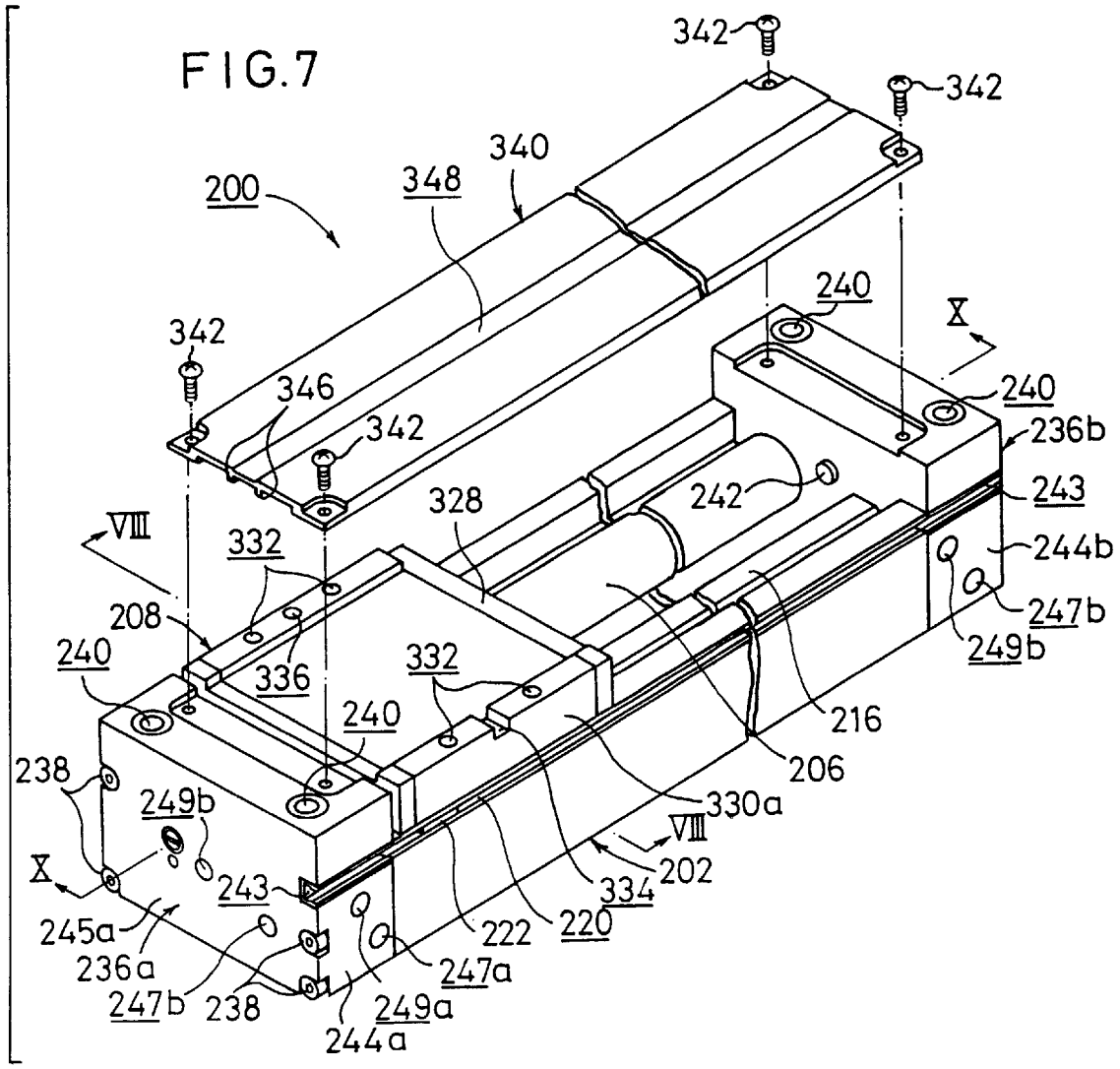
FIG. 7 shows a perspective view illustrating a rodless cylinder according to a third embodiment of the present invention.

Next, a rodless cylinder 200 according to a third embodiment will be explained with reference to FIG. 7.

Figure 8:
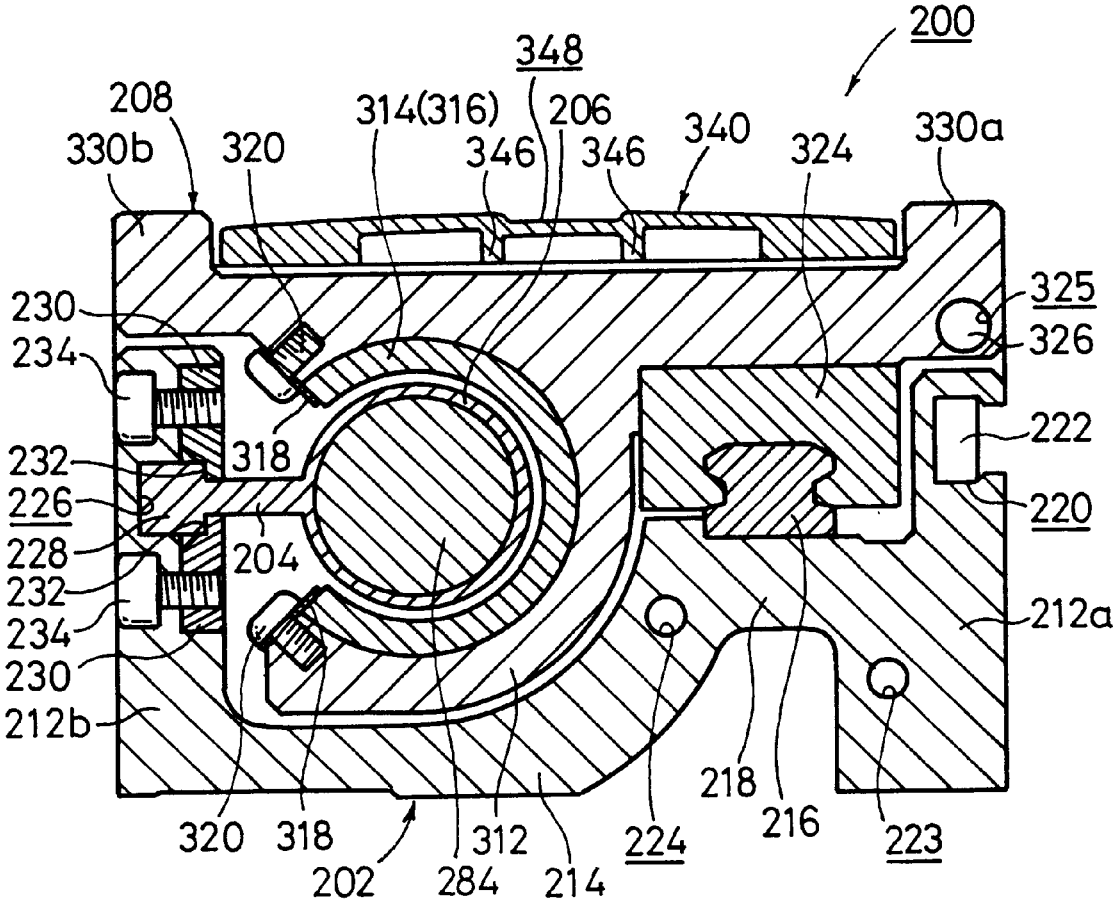
FIG. 8 shows a sectional view taken along a line VIII—VIII, illustrating the rodless cylinder shown in FIG. 7.

The rodless cylinder 200 basically comprises a lengthy base 202, a cylinder tube 206 which is supported by a support rib 204 secured along the longitudinal direction of the base 202 and extending in a substantially horizontal direction as shown in FIG. 8, and a slider 208 which is displaceable along the cylinder tube 206.

The base 202 is formed by extrusion molding by using a material such as aluminum. The base 202 has side plates 212*a,* 212*b* which are parallel to one another along the longitudinal direction. A curved section 214 which is curved along the outer circumference of the cylinder tube 206, and a guide section 218 which is flat are formed between the side plates 212*a,* 212*b*. A guide rail 216 is secured to the guide section 218. A groove 220 for a magnetic sensor is defined on the first side plate 212*a* along the longitudinal direction. The magnetic sensor 222 for detecting the position of the slider 208 is installed to the groove 220 for the magnetic sensor. Passages 223, 224, through which the pressure fluid flows, are defined in the base 202 along the longitudinal direction.

Figure 9:
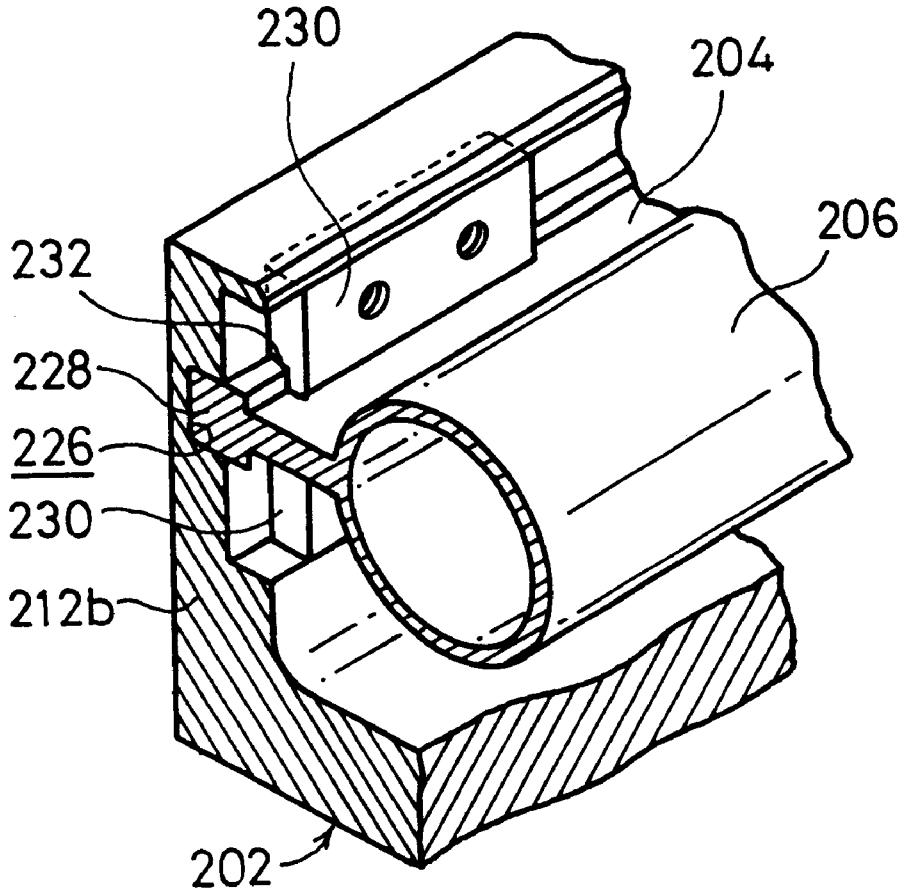
FIG. 9 shows a magnified perspective view with partial cross section illustrating an attachment state of a cylinder tube used for the rodless cylinder shown in FIG. 7.

A groove 226 is defined on the second side plate 212*b*. An engaging section 228, which is formed on the support rib 204 of the cylinder tube 206, is engaged with the groove 226 (see FIGS. 8 and 9). The engaging section 228 is formed to have a substantially rectangular cross section. A step section 232, which is formed on a fixing block 230, is engaged with the engaging section 228. The cylinder tube 206 is secured to the side plate 212*b* by fastening the fixing block 230 to the side plate 212*b* by using screws 234.

End plates 236*a,* 236*b* are secured by screws 238 to both ends of the base 202. The end plates 236*a,* 236*b* are defined with holes 240 (see FIG. 7) for inserting screws (not shown) therethrough for attaching the rodless cylinder 200 to an equipment or the like. Grooves 243, which communicate with the groove 220 for the magnetic sensor defined on the base 202, are defined on first sides of the end plates 236*a,* 236*b*. Recesses 241 are defined on surfaces of the end plates 236*a,* 236*b* on the sides of the slider 208. Dampers 242 made of a resin are inserted into the recesses 241 to slightly protrude from the end plates 236*a,* 236*b* (see FIG. 10).

Recesses 258*a,* 258*b,* which communicate with the hole 256 of the cylinder tube 206, are defined on the end plates 236*a,* 236*b*. Screw holes 260 are defined through walls which constitute the recesses 258*a,* 258*b*. First ends of inner covers (positioning members) 262 are inserted into the recesses 258*a,* 258*b*. Second ends of the inner covers 262 are inserted into the hole 256 of the cylinder tube 206. An adjusting screw section 264 for meshing with the screw hole 260 is formed on each of the inner covers 262. Accordingly, when the adjusting screw section 264 is rotated, the inner cover 262 is displaced along the recesses 258*a,* 258*b*. Flanges 266 are formed on the outer circumferences of the inner covers 262 respectively. On the other hand, recesses 267, in which the flanges 266 are displaceable, are formed on the end plates 236*a,* 236*b* respectively. Therefore, the flange 266 is displaceable within a range from the step section 268 of the recess 267 and the end of the cylinder tube 206. The displacement range of the inner cover 262 is regulated by the step section 268 and the end of the cylinder tube 206. A screw 270 for fixing the position of the inner cover 262 is provided for each of the end plates 236*a,* 236*b*.

Figure 11:
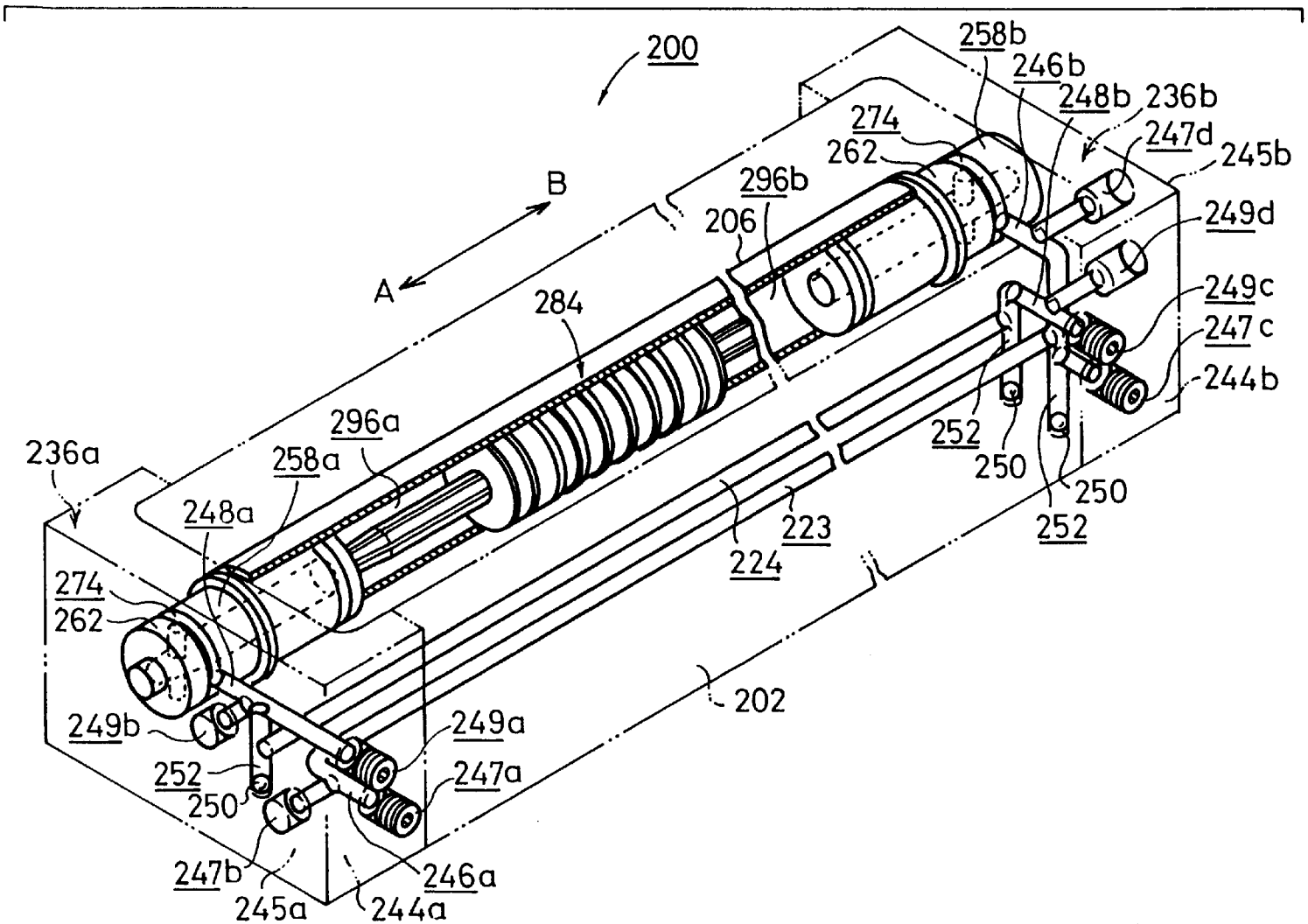
FIG. 11 shows a perspective view with partial omission, illustrating passages and ports formed in the rodless cylinder shown in FIG. 7.

A groove 274 is formed in a circumscribing manner on the outer circumference of the inner cover 262. On the other hand, a chamber 276, which extends in the axial direction and which is open on the side of the cylinder tube 206, is defined at the inside of each of the inner covers 262. The grooves 274 communicate with the chambers 276 via passages 278*a,* 278*b* respectively. As shown in FIG. 11, the groove 247 of the first inner cover 262 communicates with the port 249*a* formed on the side surface 244*a* of the end plate 236*a* and the port 249*b* formed on the end surface 245*a* via the passage 248*a* formed in the end plate 236*a*. The passage 248*a* communicates with the port 249*c* formed on the side surface 244*b* of the end plate 236*b* and the port 249*d* formed on the end surface 245*b* via the passage 224 of the base 202 and the passage 248*b* formed in the end plate 236*b*. Further, the groove 274 of the second inner cover 262 communicates with the port 247*c* formed on the side surface 244*b* and the port 247*d* formed on the end surface 245*b* via the passage 246*b* formed in the end plate 236*b,* and it communicates with the port 247*a* formed on the side surface 244*a* and the port 247*b* formed on the end surface 245*a* via the passage 223 of the base 202 and the passage 246*a* formed in the end plate 236*a*. Accordingly, when an unillustrated pressure fluid supply source is connected to any one of the ports 249*a* to 249*d,* the pressure fluid can be supplied to the chamber 276 of the inner cover 262 disposed on the first end side of the cylinder tube 206. Similarly, when the pressure fluid supply source is connected to any one of the ports 247*a* to 247*b,* the pressure fluid can be supplied to the chamber 276 of the inner cover 262 disposed on the second end side of the cylinder tube 206. The port 247*a* to 247*d,* 249*a* to 249*d,* which are not used, are closed by plug members (not shown). The passages 246*b,* 248*a,* 248*b* are open to lower portions of the end plates 236*a,* 236*b* via holes 252 provided to form portions for the passages 246*b,* 248*a,* 248*b* to be directed in the vertical direction. Open portions are closed by rigid spheres 250 forcibly inserted thereinto.

O-rings 280*a,* 280*b,* which abut against the inner covers 262, are provided on the walls of the recesses 258*a,* 258*b* respectively. On the other hand, O-rings 282, which abut against the inner wall of the cylinder tube 206, are provided on the outer circumferences of the inner covers 262 respectively. The pressure fluid supplied to the grooves 274 is prevented from leakage from the gaps between the walls of the recesses 258*a,* 258*b* and the outer circumferences of the inner covers 262, by the aid of the respective O-rings 280*a,* 280*b*. The pressure fluid is prevented from leakage from the gaps between the inner circumference of the cylinder tube 206 and the outer circumferences of the inner covers 262, by the aid of the respective O-rings 282. O-rings 283 are provided on the walls of the chambers 276 respectively.

The cylinder tube 206 is made of a material such as aluminum, and it is formed by extrusion molding integrally with the support rib 204. A piston 284 is provided slidably at the inside of the cylinder tube 206. The piston 284 is alternately arranged with a plurality of ring members 32 and driving magnets 34 in the same manner as in the rodless cylinders 10, 100 according to the first and second embodiments. An unillustrated shaft is inserted into the ring members 32 and the driving magnets 34. Rod members 294 are secured to both ends of the shaft along the longitudinal direction of the piston 284. The ring members 32 and the driving magnets 34 are interposed by columnar members 290. Bushes 291, which are slidable on the inner circumference of the cylinder tube 206, are provided on the outer circumferences of the columnar members 290 respectively. Packings 202, which abut against the inner circumference of the cylinder tube 206, are provided on the outer circumferences of the columnar members 290 respectively. The interior of the cylinder tube 206 is separated by the piston 284 into a chamber 296*a* disposed on a first end side and a chamber 296*b* disposed on a second end side.

The rod members 294 are insertable into the chambers 276 of the inner covers 262. When the rod member 294 enters the chamber 276, then the pressure fluid in the chambers 296*a,* 296*b* is compressed, and the end surface of the columnar member 290 is pressed thereby. The rod member 294 has its end which is formed such that the diameter is gradually reduced. A plurality of grooves 302 are defined on the outer circumference of the rod member 294 along its axial direction. Bottoms of the grooves 302 are formed to be inclined toward the end of the rod member 294.

A curved section 312 is formed at a lower portion of the slider 208 to cover the cylinder tube 206 therewith (see FIG. 8). The curved section 312 is alternately arranged with driven magnets 316 and yokes 314 formed to have a substantially C-shaped configuration and composed of a magnetic material. The yokes 314 and the driven magnets 316 are interposed by spacers 322 (see FIG. 10). Plate-shaped fixing members 318 are fastened by screws 320 to the curved section 312 of the slider 208 to abut against ends of the driven magnets 316 and the yokes 314. The fixing members 318 avoid positional deviation which would be otherwise caused when the driven magnets 316 and the spacers 322 are installed to the slider 208.

Figure 12:
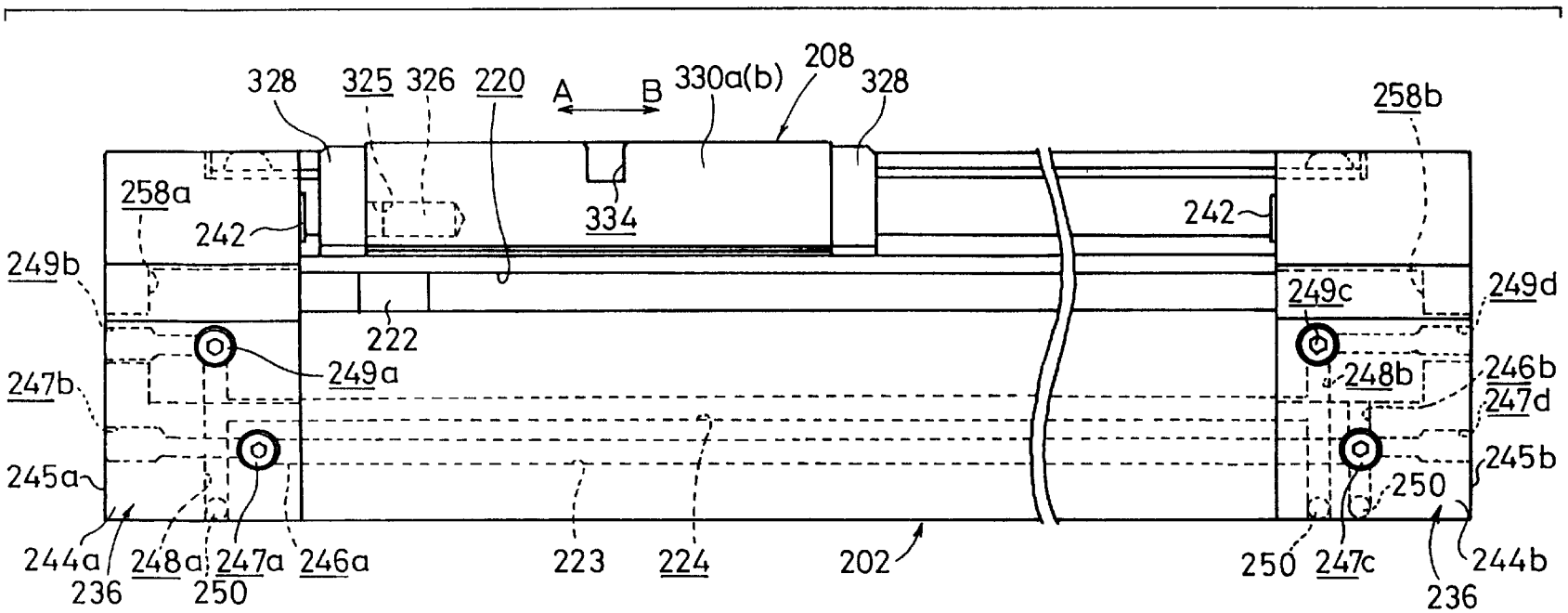
FIG. 12 shows a side view illustrating the rodless cylinder shown in FIG. 7.

A guide block (guide element) 324 for slidably engaging the guide rail 216 is secured to a lower portion of the slider 208. The yokes 314 and the driven magnets 316 are held to make no contact with the outer circumference of the cylinder tube 206 by the aid of the guide rail 216 and the guide block 324. A hole 325 is defined along the longitudinal direction of the rodless cylinder 200 in the vicinity of one edge of the slider 208. A magnet 326 for detecting the position is inserted into the hole 325 (see FIG. 12). Accordingly, when the slider 208 is displaced to allow the magnet 326 to make approach to the magnetic sensor 222, the magnetic sensor 222 outputs a signal indicating this situation.

End members 328 are secured to the ends of the slider 208. The end members 328 avoid disengagement of the yokes 314, the driven magnets 316, and the spacer 322.

Both sides of the top of the slider 208 protrude upwardly to form attachment sections 330*a,* 330*b*. A plurality of workpiece attachment screw holes 332 are defined in the attachment sections 330*a,* 330*b* (see FIG. 7). A groove 334 for positioning the workpiece is defined on one of the attachment sections 330*a*. A pin hole 336 is defined on the other attachment section 330*b*.

The end plates 236*a,* 236*b* of the rodless cylinder 200 are bridged with a top cover 340. The attachment sections 330*a,* 330*b* of the slider 208 protrude upwardly from sides of the top cover 340. The top cover 340 is fastened to the end plates 236*a,* 236*b* by the aid of screws 342. The top cover 340 is made of a material such as aluminum. A groove 348 is formed on the upper surface of the top cover 340 along the longitudinal direction. A plurality of reinforcing sections 346 are formed on the lower surface of the top cover 340 along the longitudinal direction in order to improve the strength of the top cover 340.

The rodless cylinder 200 is designed such that the cylinder tube 206, the guide rail 216, the guide block 324, and other components are accommodated in the interior of the side plates 212*a,* 212*b* and the top cover 340. Therefore, it is possible to suppress the fear that any dust or the like would be scattered to the outside of the rodless cylinder 200.

The rodless cylinder 200 according to the third embodiment is basically constructed as described above. Next, its operation, function, and effect will be explained.

At first, any one of the ports 247*a* to 247*d* and any one of the ports 249*a* to 249*d* are connected to the pressure fluid supply source via the unillustrated solenoid-operated valves. In this case, for example, when the ports 247*a,* 249*a* provided on the end plate 236*a* are connected to the solenoid-operated valves, the other ports 247*b,* 249*b* provided on the end plate 236*a* and the ports 247*c,* 247*d,* 249*c,* 249*d* provided on the end plate 236*b* are closed by using plug members (not shown). As described above, it is sufficient to use any one of the ports 249*a* to 249*d* and any one of the ports 247*a* to 247*d* which are formed on any of the side surface 244*a* on the first end side, the end surface 245*a,* the side surface 244*b* on the second end side, and the end surface 245*b* of the rodless cylinder 200. Therefore, the degree of freedom of piping is improved.

Figure 10:
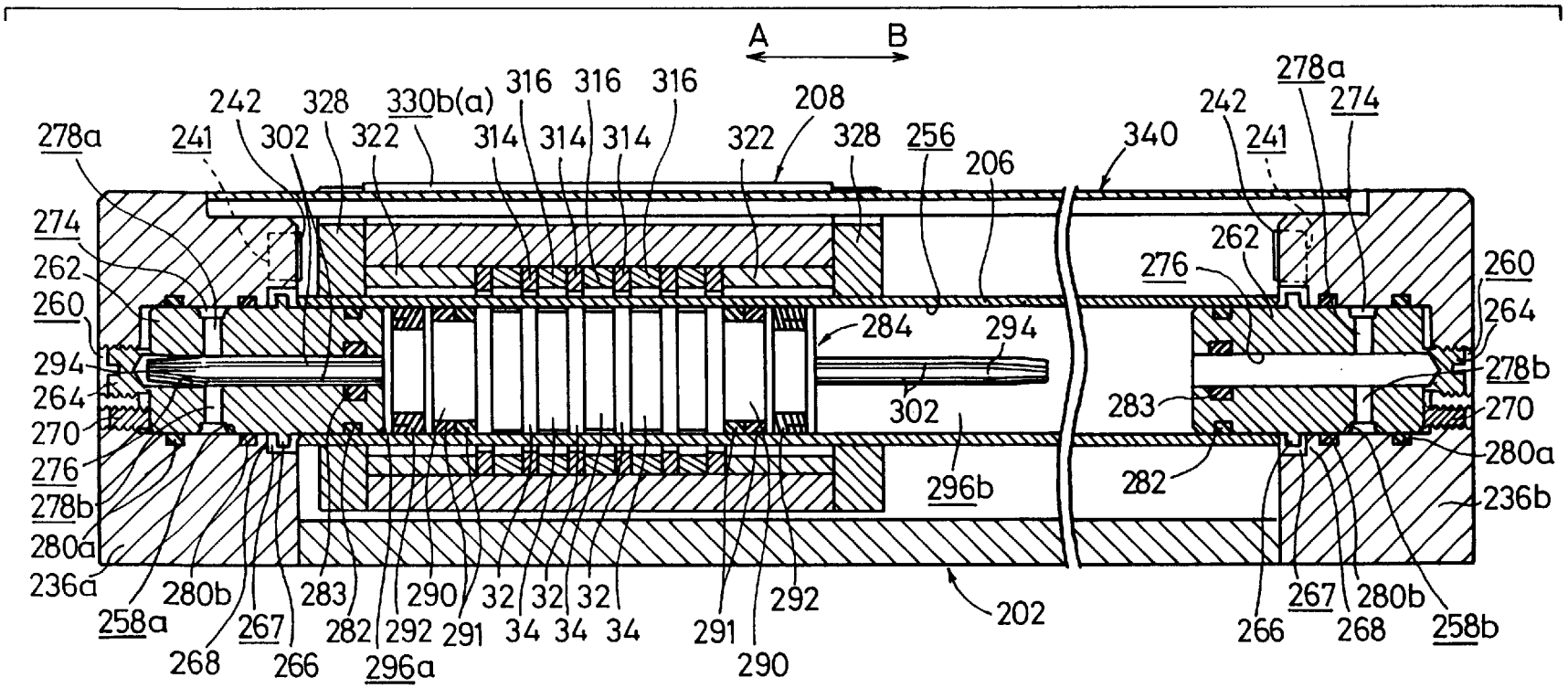
FIG. 10 shows a sectional view taken along a line X—X, illustrating the rodless cylinder shown in FIG. 7.

The adjusting screw sections 264 of the inner covers 262 are rotated to displace the inner covers 262 in the axial direction so that the stop positions of the piston 284 are finely adjusted (see FIG. 10). Accordingly, the stop positions of the slider 208 are finely adjusted.

After performing the preparatory steps as described above, the unillustrated solenoid-operated valves are operated. When the pressure fluid is introduced into the first port 249*a,* and the second port 247*a* is in the state open to the atmospheric air, then the pressure fluid is introduced from the passage 248*a* into the chamber 276 via the groove 274 and the passages 278*a,* 278*b* of the inner cover 262. Further, the pressure fluid passes through the grooves 302 of the rod member 294, and it is introduced into the chamber 296*a.* Accordingly, the piston 284 slides in the direction indicated by the arrow B in accordance with the pressure of the pressure fluid. The driving magnets 34 are displaced, and the yokes 314 are attracted by the magnetic force thereof. Thus, the slider 208 is displaced in the direction of the arrow B along the cylinder tube 206.

When the piston 284 approaches the end on the side of the end plate 236*b,* the rod member 294 enters the chamber 276 of the inner cover 262. The pressure fluid in the chamber 296*b* is compressed by the piston 284, and the resultant pressure presses the end surface of the piston 284. Thus, the displacement speed of the piston 284 is decelerated. Accordingly, the slider 208 is prevented from sudden stop at the end of the stroke, and the dust generation which would be otherwise caused by the shock of the sudden stop is avoided.

The end of the columnar member 290 of the piston 284 abuts against the inner cover 262. Accordingly, the piston 284 is stopped, and the slider 208 is also stopped.

When the unillustrated solenoid-operated valves are operated so that the first port 249*a* is in the state open to the atmospheric air while the pressure fluid is introduced into the second port 247*a,* then the pressure fluid passes from the passage 246*a* through the passages 223, 246*b,* the groove 274, the passages 278*a,* 278*b,* and the chamber 276. The pressure fluid is introduced into the chamber 296*b*. Thus, the piston 284 slides in the direction indicated by the arrow A. Accordingly, the slider 208 is displaced in the direction of the arrow A in the same manner as described above.

The rodless cylinder 200 according to the third embodiment is advantageous in the same manner as in the rodless cylinders 10, 100 according to the first and second embodiments. That is, the cylinder tube 206 is supported by the support rib 204. Accordingly, even when the cylinder tube 206 is formed to be long, there is no fear of warpage of the cylinder tube 206. Therefore, it is easy to enlarge the displacement range of the slider 208. Further, there is no fear of dust generation which would be otherwise caused by the contact between the cylinder tube 206 and the driven magnets 316 and the yokes 314.

Further, the support rib 204 for the cylinder tube 206 extends in the horizontal direction. Therefore, it is possible to suppress the dimension in the height direction of the rodless cylinder 200, and it is possible to effect the stable displacement action with the low center of gravity.

Further, it is sufficient to use any one of the ports 249*a* to 249*d* and any one of the ports 247*a* to 247*d* which are formed on any one of the side surface 244*a* on the first end side, the end surface 245*a,* the side surface 244*b* on the second end side, and the end surface 245*b*. Therefore, it is possible to improve the degree of freedom of piping, and it is easy to perform the piping work.

What is claimed is:

1. A rodless cylinder comprising;

a base;

a guide rail disposed on said base extending in a longitudinal direction;

a cylinder tube disposed on said base along said longitudinal direction;

a support rib disposed along said longitudinal direction and formed in an integrated manner with said cylinder tube, said support rib being disposed on said base parallel to and alongside said guide rail;

a piston arranged in said cylinder tube and slidable along said longitudinal direction of said cylinder tube;

a driving magnet arranged on said piston;

a substantially C-shaped yoke comprising a magnetic member arranged in close proximity in a non-contact state with respect to an outer circumference of said cylinder tube and being displaceable along said cylinder tube in accordance with an action of said driving magnet;

a slider in which said C-shaped yoke is accommodated, said slider further comprising a guide element for slidably engaging with said guide rail, wherein said slider and said yoke are held in a non-contact state with respect to said cylinder tube and said support rib by said guide member and said guide rail, said slider and said yoke being slidable with respect to said cylinder tube but without contacting said cylinder tube.

2. The rodless cylinder according to claim 1, wherein said slider is provided with a magnet, while a base, on which said support rib is disposed, is provided with a magnetic sensor for detecting said slider by detecting magnetic force of said magnet.

3. The rodless cylinder according to claim 1, wherein cap members are provided at ends of said cylinder tube, while said piston is provided with dampers, so that said dampers absorb shock upon collision of said piston with said cap members.

4. The rodless cylinder according to claim 1, wherein end plates are provided at ends of said cylinder tube, and said end plates are provided with dampers respectively, so that said dampers absorb shock upon collision of said slider with said end plates.

5. The rodless cylinder according to claim 1, wherein chambers for compressing a pressure fluid in accordance with a displacement action of said piston is formed at an end of said cylinder tube, and said piston is pressed by a pressure of said pressure fluid compressed in said chambers so that its displacement speed is decreased.

6. The rodless cylinder according to claim 1, wherein a chamber disposed on a first end side and a chamber disposed on a second end side, which are isolated by said piston, are formed in said cylinder tube, and ports, which communicate with said chambers disposed on said first and second end sides respectively, are provided on both ends of said rodless cylinder.

7. The rodless cylinder according to claim 1, wherein a chamber disposed on a first end side and a chamber disposed on a second end side, which are isolated by said piston, are formed in said cylinder tube, and ports, which communicate with said chambers disposed on said first and second end sides respectively, are provided on side surfaces and end surfaces of said rodless cylinder.

8. The rodless cylinder according to claim 1, wherein said support rib is arranged to extend in a vertical direction.

9. The rodless cylinder according to claim 1, wherein said support rib is arranged to extend in a horizontal direction.

10. The rodless cylinder according to claim 1, wherein said support rib is arranged to extend in an inclined direction.

11. The rodless cylinder according to claim 1, wherein said rodless cylinder comprises a plurality of cylinder tubes provided with said support ribs, and said support ribs are joined to one another.

12. The rodless cylinder according to claim 1, wherein a positioning member, which is capable of making abutment against said piston, is provided at an end of said cylinder tube, and a displacement range of said piston is adjusted by adjusting a position of said positioning member along said longitudinal direction of said cylinder tube.

* * * * *